US006317945B1

(12) United States Patent
Laphan et al.

(10) Patent No.: US 6,317,945 B1
(45) Date of Patent: Nov. 20, 2001

(54) CASKET HARDWARE WITH INTERCHANGEABLE COMPONENTS

(75) Inventors: Dennis C. Laphan; Ilija Rojdev, both of Cincinnati, OH (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/274,610

(22) Filed: Mar. 23, 1999

(51) Int. Cl.[7] ..... A61G 17/00
(52) U.S. Cl. ..... 27/10; 52/287.1
(58) Field of Search ..... 27/2, 10, 13, DIG. 99, 27/27; 52/718.04, 716.1, 287.1

(56) References Cited

U.S. PATENT DOCUMENTS

| | | | | |
|---|---|---|---|---|
| D. 49,876 | | 11/1916 | Bailey . | |
| D. 78,875 | | 7/1929 | Blesch . | |
| D. 93,002 | | 8/1934 | Burkard . | |
| D. 108,917 | | 3/1938 | Larson . | |
| D. 208,917 | | 10/1967 | Mellyn . | |
| 216,749 | * | 6/1879 | McAlister | 27/10 |
| 253,708 | * | 2/1882 | Hutchinson | 27/10 |
| D. 278,174 | | 3/1985 | Christian . | |
| 331,981 | | 12/1885 | Lovett . | |
| 331,982 | | 12/1885 | Lovett . | |
| 1,001,424 | | 8/1911 | Montross . | |
| 2,106,695 | | 1/1938 | Larson . | |
| 2,213,506 | | 9/1940 | Thoresen . | |
| 2,450,091 | | 9/1948 | Kendall . | |
| 3,025,624 | | 3/1962 | Harrell . | |
| 3,681,887 | | 8/1972 | Loew . | |
| 3,823,447 | | 7/1974 | Johnson . | |
| 4,066,285 | | 1/1978 | Hall et al. . | |
| 4,077,096 | | 3/1978 | Christian . | |
| 4,195,394 | | 4/1980 | Semon . | |
| 4,243,711 | | 1/1981 | Wenrick . | |
| 4,267,623 | | 5/1981 | Christian . | |
| 4,268,078 | | 5/1981 | Nomura et al. . | |
| 4,304,031 | | 12/1981 | Semon et al. . | |
| 4,571,790 | | 2/1986 | James, III . | |
| 4,638,532 | | 1/1987 | Yang et al. . | |
| 4,853,263 | | 8/1989 | Nagata et al. . | |
| 5,014,486 | | 5/1991 | Mayle . | |
| 5,108,801 | | 4/1992 | Takahashi . | |
| 5,241,729 | | 9/1993 | MacKirdy . | |
| 5,335,402 | | 8/1994 | Semon . | |
| 5,377,395 | | 1/1995 | Maier et al. . | |
| 5,421,180 | | 6/1995 | Rojdev . | |
| 5,560,175 | | 10/1996 | Soyka, Jr. et al. . | |
| 5,604,965 | | 2/1997 | Shaw et al. . | |
| 5,898,980 | * | 5/1999 | Havranek et al. | 27/27 |

* cited by examiner

*Primary Examiner*—Brian K. Green
(74) *Attorney, Agent, or Firm*—Wood, Herron & Evans, L.L.P.

(57) ABSTRACT

A trim piece for attachment to a casket to provide both decoration and concealment of mounting hardware. The trim piece includes a frame member which is adapted to be fixedly secured to a portion of the casket. The frame member has a lip which defines an opening in the frame member. A cover member with at least two attachment tabs disposed on opposite edges of the cover member engages the lip of the frame member so that the cover member is detachably affixed to and covers the opening in the frame member. In one aspect of the device, the trim piece is specifically constructed to affix to a corner of the casket. In another aspect of the device, the trim piece is specifically constructed to affix to the side of the casket. In yet another aspect of the device, the trim piece is a single, integrally formed corner piece where a living hinge pivotally connects the cover member to the frame member.

36 Claims, 7 Drawing Sheets

CASKET HARDWARE WITH INTERCHANGEABLE COMPONENTS

FIELD OF THE INVENTION

The present invention generally relates to hardware for caskets and, more specifically, to interchangeable, decorative hardware for caskets.

BACKGROUND OF THE INVENTION

Existing hardware designs for burial containers such as caskets frequently employ the use of decorative elements separately affixed to the handling hardware, or jointly affixed with the handling hardware to the casket shell, as a means to create product variety with minimal manufacturing and component inventory costs. As such, the decorative scheme of the casket can be tailored to suit a customer's wishes with minimal effort and expense. Throughout the handling and presentation of the casket, the decorative elements, in addition to the handling hardware, must be capable of withstanding load bearing activities, such as when a casket is removed from a hearse by tugging on a casket handle.

To withstand these load bearing activities, the decorative elements are either adhesively affixed, such as with a decal, or mechanically attached via a stud/bolt and nut/clip combination, such as with a sculptural base relief. These types of attachment techniques, however, have distinct disadvantages and drawbacks. For example, one drawback is that the process for adhesively attaching the decorative element is not pragmatically reversible. That is, once the first decorative element is adhesively applied, the decorating scheme can be altered only by applying a second adhesive decorative element over the first, thereby wasting material in the process. Another drawback is that the decorative elements may not readily lend themselves to mechanical attachment to the handling hardware and/or casket shell, thus requiring elaborate and expensive attachment apparatus. In sum, the disadvantages in these current methods for attaching decorative elements are that the process is neither pragmatically reversible in the case of the adhesive attachment, nor physically facile in the case of the mechanical attachment.

To further serve the load bearing activities of casket handling and presentation, the handling hardware frequently is secured to the casket by mechanical means, most frequently by screws and/or bolts. These screws and bolts are readily visible on the exterior of the casket. As can be appreciated, the exposure of these screws and bolts in the handling hardware detracts from the aesthetics of the casket exterior.

It is therefore desirable from an aesthetic yet economical vantage point, if an interchangeable decorative element could be constructed to be readily affixed to the handling hardware with minimal effort or added expense. More specifically, it is desirable to have a decorative element that could be easily substituted with another decorative element to alter the decorative scheme of the exterior of the casket. Furthermore, it is desirable to have the decorative piece configured such that when affixed to the handling hardware the attachment screws and bolts would be concealed from normal view in the presentation and use of the casket.

SUMMARY OF THE INVENTION

The invention is generally directed to a trim piece for attachment to a casket. The trim piece includes a frame member which is adapted to be fixedly secured to a portion of the casket. The frame member has a lip which defines an opening in the frame member. A cover member with at least two attachment tabs oppositely disposed on the cover member engages the lip of the frame member so that the cover member is detachably affixed to and covers the opening in the frame member.

In one aspect of the trim piece, the lip defining the opening in the frame member includes oppositely disposed receiving tabs for positively engaging the attachment tabs on the cover member. Furthermore, the cover member is constructed from a flexible material and is affixed to said frame member in a flexed condition such that the attachment tabs resiliently engage the receiving tabs located on the lip of the frame member.

In another aspect of the invention, at least one of the attachment tabs on the cover member has an extended portion which incorporates a detent mechanism for positively engaging a complimentary recess in the lip to further secure the cover member to the frame member. Additionally, the lip includes a throughhole which is covered on one side of the lip by the extended portion. The throughhole is adapted to allow a tool to be inserted into the throughhole to engage and thereby bias the extended portion such that the detent mechanism disengages from the recess, allowing the cover member to be readily removed from the frame member.

In one embodiment of the invention, the trim piece is a corner trim piece specifically constructed to attach to a corner of the casket. Specifically, the frame member includes a bridge member which is affixed to opposite sides of and thereby spans across the opening. The attachment bridge has a throughhole for receiving mounting hardware to detachably secure the frame member to the corner of the casket. The frame member can be secured to the corner of the casket using any suitable form of mounting hardware. Preferably, the mounting hardware is a screw or bolt, and more preferably, a quarter-turn screw.

In another aspect of the corner trim piece, the frame member does not include the bridge member, but instead has at least two mounting holes which are adapted to receive mounting hardware to fixedly secure the frame member to the corner of the casket. In this corner trim piece, the cover member has adjoining first and second walls which form a right angle therebetween. Each of the walls has at least one of the attachment tabs for engaging the lip of the frame member. Preferably, the cover member includes first and second protruding tabs on the respective first and second walls. The protruding tabs are adapted to conceal any mounting hardware which is cooperating with the mounting holes to affix the frame member to the corner of the casket. In another aspect of this embodiment, a living hinge connects the adjoining first and second walls.

In another embodiment of the invention, the trim piece is a side trim piece specifically constructed to attach to a side of the casket. This side trim piece may also be referred to as an ear or escutcheon trim piece. In this embodiment the cover member is substantially planar and flexible. As such, the cover member is affixed to the frame member in a flexed condition such that the attachment tabs resiliently engage oppositely disposed receiving tabs on the lip. Preferably, the side trim piece includes a mounting plate that is fixedly attached to the frame member. The mounting plate is adapted to secure the frame member to the side of the casket. In another aspect of this embodiment the trim piece further includes first and second handle supports which are attached to the frame member. Each of the handle supports have first and second handle receiving openings into which a handle is disposed.

In still another embodiment, a trim piece is integrally formed and suited for attachment to a corner of a casket. This trim piece includes a frame portion having an opening therethrough. A bridge member spans the opening and has a throughhole which is adapted to receive mounting hardware to fixedly secure the integrally formed trim piece to the corner of the casket. A cover member is pivotally attached along a first edge of the opening by a living hinge. The cover member has an attachment tab disposed opposite the living hinge for engaging a second edge of the opening when the cover member is pivoted to cover the opening.

Various additional advantages, objects and features of the invention will become more readily apparent to those of ordinary skill in the art upon consideration of the following detailed description of the presently preferred embodiment taken in conjunction with the accompanying drawings.

DETAILED DESCRIPTION OF THE DRAWINGS

DETAILED DESCRIPTION OF PREFERRED EMBODIMENTS

Figure 1:
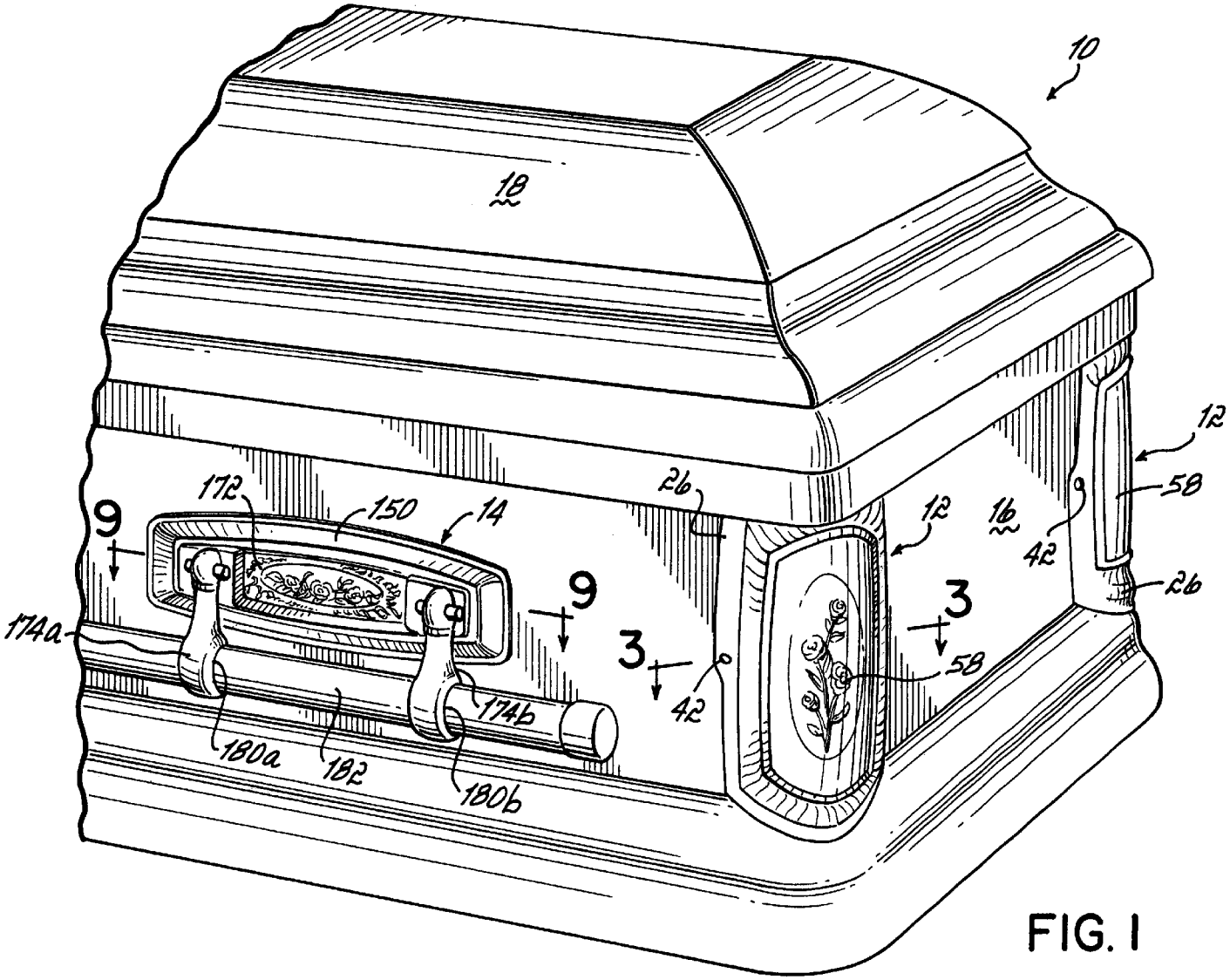
FIG. 1 is a partial perspective view of a casket with the decorative hardware of the invention affixed to the corner and side of the casket.

Referring first to FIG. 1, a burial container or casket 10 is shown with a corner decorative element 12 and a side decorative element 14 constructed in accordance with the principles of the invention. The casket 10 is constructed in conventional fashion with a casket shell 16 and a casket cap 18 enclosing the casket shell 16.

Figure 2:
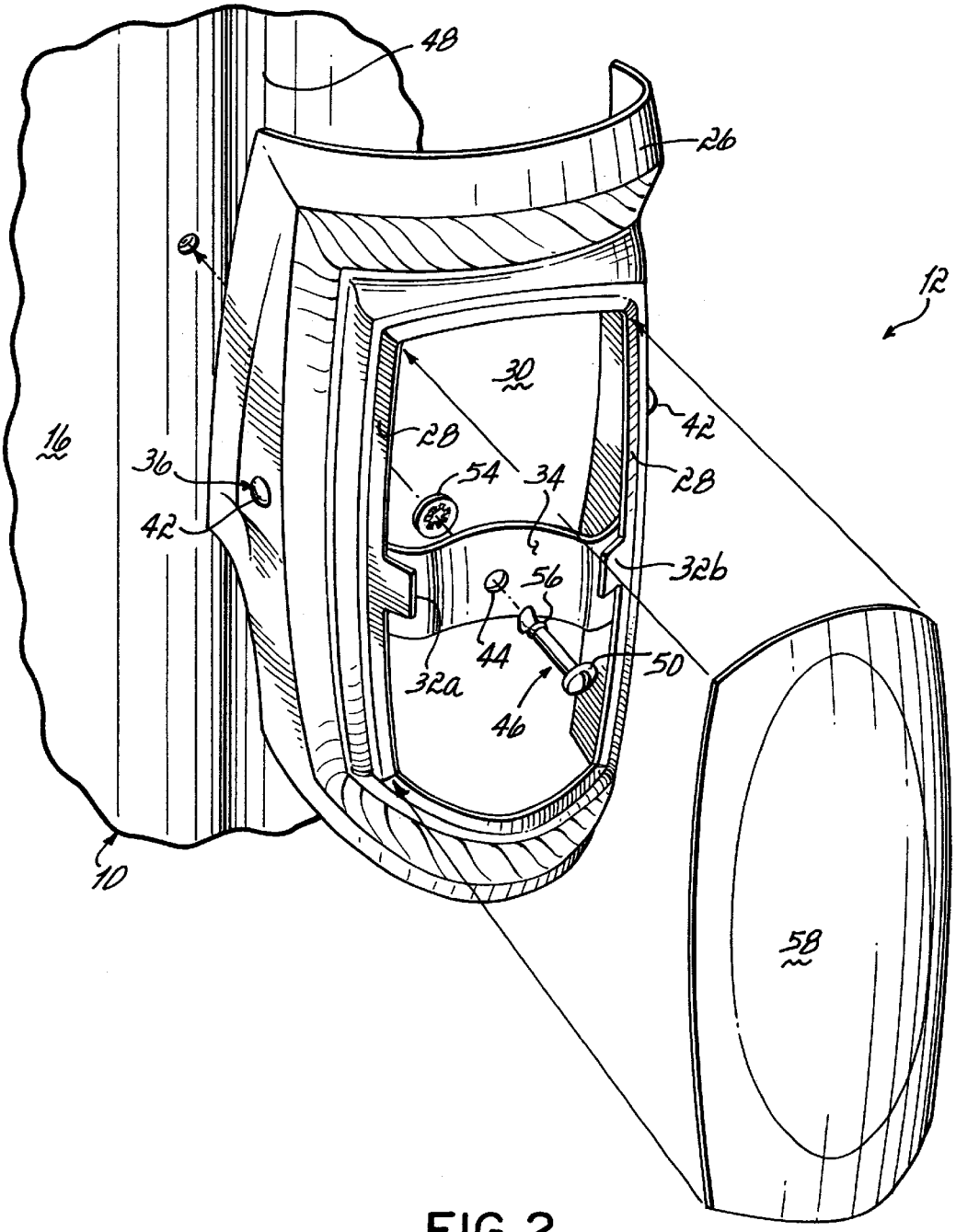
FIG. 2 is a disassembled perspective view of one embodiment of the decorative hardware used on the corner of the casket shown in FIG. 1.
Figure 3:
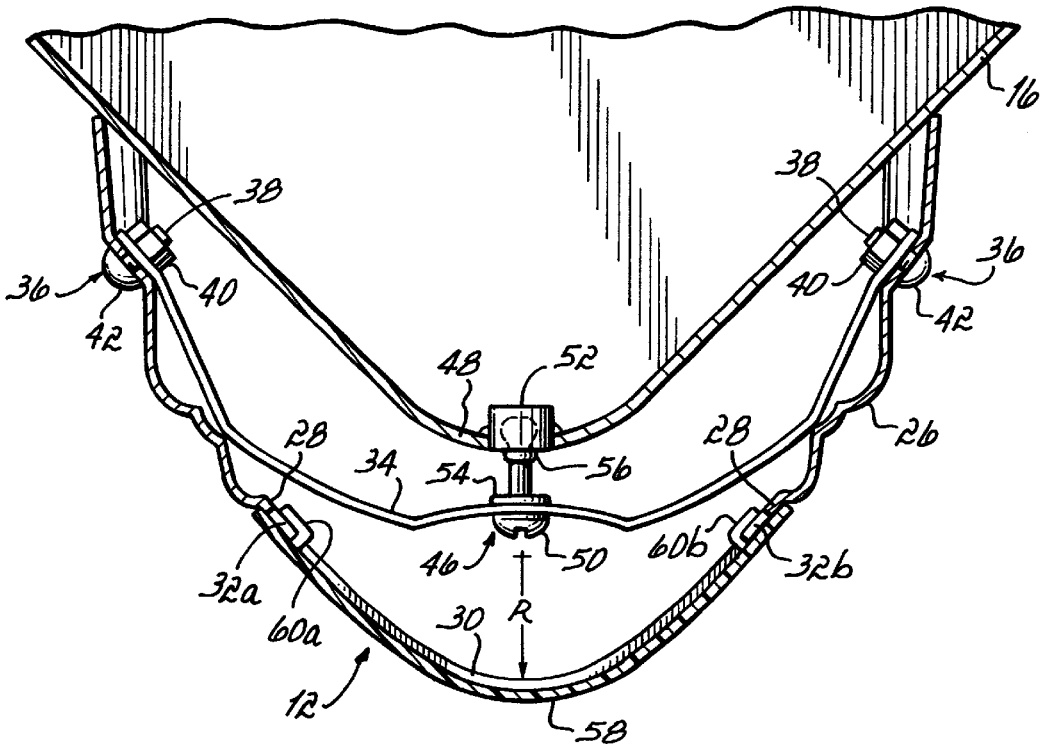
FIG. 3 is an enlarged cross-sectional view of the decorative corner hardware of FIG. 1 taken along line 3—3.

With reference now to FIGS. 2 and 3, the corner decorative element 12 has a frame member 26 which has a lip 28 defining an opening 30 in the frame member 26. The frame member 26 is constructed preferably of a substantially rigid, yet lightweight, structural material. The lip 28 has oppositely disposed receiving tabs 32*a*, 32*b*. The frame member 26 also includes a bridge member 34 which spans across the opening 30. The bridge member 34 is affixed on opposite sides of the opening 30 by suitable mounting hardware 36. As illustrated in FIG. 3, the mounting hardware 36 is preferably a bolt 38 threadingly engaged to nut 40. To provide a more aesthetically pleasing appearance as well as conceal a head 42 of the bolt 38, the head 42 is plated to match the color and texture of the frame member 26. The bridge member 34 includes a throughhole 44 through which mounting hardware 46 is inserted to attach the frame member 26 to a corner 48 of the casket shell 16. The mounting hardware is preferably a screw or bolt. More preferably, however, and as shown in FIG. 3, a quarter-turn screw 50 engages a receiving member 52 so that the frame member 26 can be readily attached to the corner 48 of the casket shell 16. A star washer 54 cooperates with a shoulder 56 at one end of the screw 50 to retain the screw 50 onto bridge member 34 during handle and installation of the frame member 26.

The corner decorative element 12 also includes a decorative cover member 58 to which oppositely disposed attachment tabs 60*a*, 60*b* are affixed or otherwise formed therewith. The attachment tabs 60*a*, 60*b* may be integrally formed as part of the cover member 58 or alternatively may be separate pieces which are secured to the cover member 58 by any suitable means such as by adhesive. The cover member 58 is constructed from a flexible material, such as plastic, and dimensioned such that the cover member 58 must be flexed in order for the attachment tabs 60*a*, 60*b* to slip over the receiving tabs 32*a*, 32*b*. As such, the cover member 58 is affixed to the frame member 26 in a flexed condition such that the attachment tabs 60*a*, 60*b* resiliently engage the receiving tabs 32*a*, 32*b*.

As can be readily appreciated and in accordance with the principles of this invention, the cover member serves at least two functions. First, in its attached position, the cover member 58 serves to hide or conceal the bridge member 34 and its associated mounting hardware 36, yielding a more aesthetically pleasing corner decorative element 14. Secondly, because the cover member 58 is so readily attached and detached from the stationary frame member 26, a wide variety of cover members 58 can be used to provide a customer with several different decorating options with little additional manufacturing expense. Such options can be selected by a customer at the funeral home, with the funeral director maintaining on hand a variety of styles of such cover members 58 from which the customer may choose.

Figure 3A:
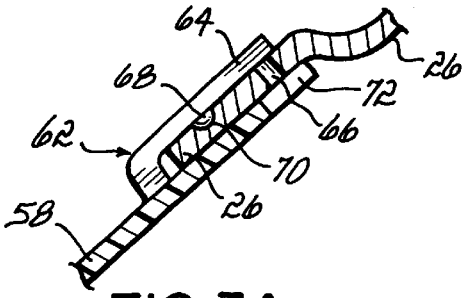
FIG. 3A is an enlarged cross-sectional view of another embodiment of the decorative corner hardware showing a integral release mechanism.

In FIG. 3A an alternate attachment tab 62 is shown. This attachment tab 62 has an extended portion 64 which extends beyond the receiving tab 32*b* to cover one side of a throughhole 66 in the lip 28. The extended portion 64 has a detent mechanism 68 that positively engages a recess 70 in the receiving tab 32*b*. As such, the alternate attachment tab 62 along with the detent mechanism 68 functions to more securely affix the cover member 58 to the frame member 26.

Figure 4:
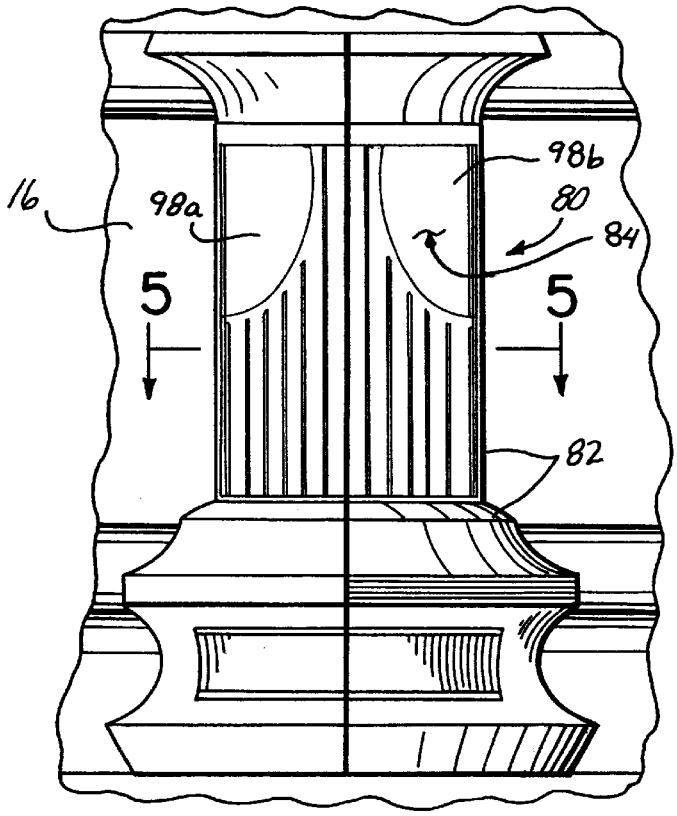
FIG. 4 is a partial elevational view of another embodiment of the corner decorative hardware mounted to a casket.
Figure 5:
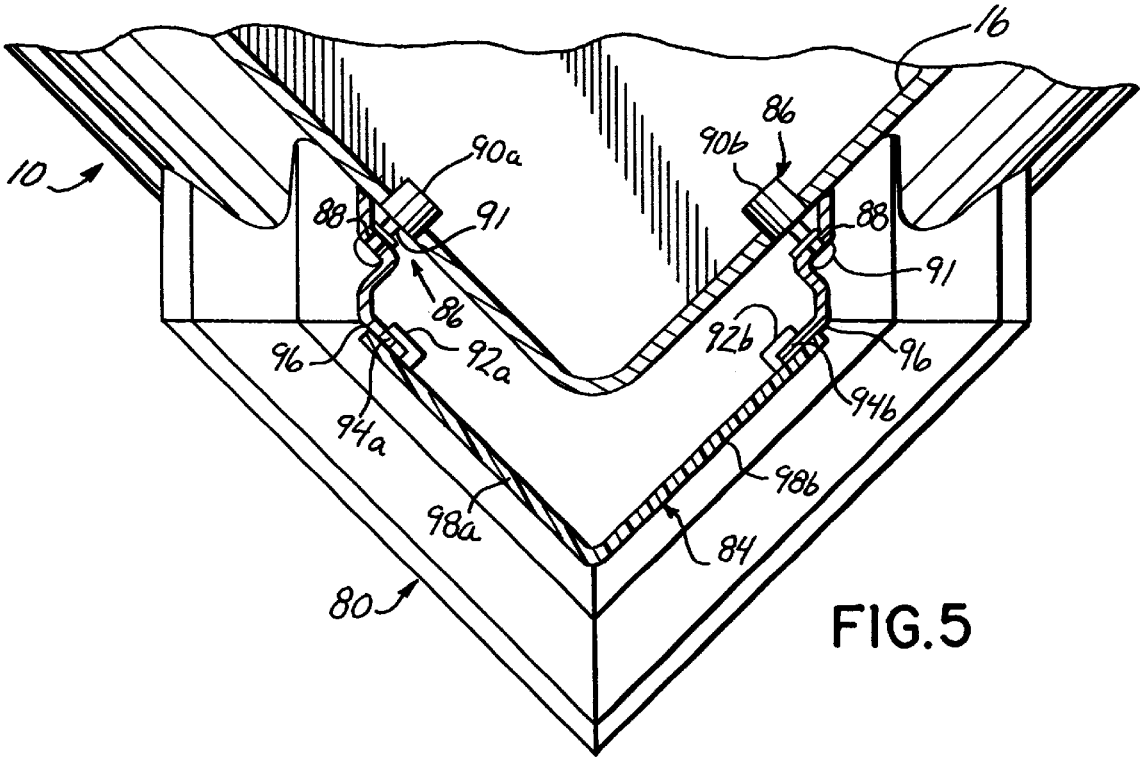
FIG. 5 is an enlarged cross-sectional view of the decorative corner hardware of FIG. 4 taken along line 5—5.

Referring now to FIGS. 4 and 5, another embodiment of a corner decorative element 80 is shown. The corner decorative element 80 has a frame member 82 to which a cover member 84 is detachably affixed. In this embodiment, the frame member 82 is mounted to the casket shell 16 by means of mounting hardware 86 inserted into mounting throughholes 88 and cooperating with receiving members 90*a*, 90*b* in casket shell 16. As shown, the mounting hardware 86 is preferably a quarter-turn screw 91 so that the frame member can be quickly attached to the casket shell 16 with minimal effort. The cover member 84 has oppositely disposed attachment tabs 92*a*, 92*b* which engage respectively receiving tabs 94*a*, 94*b* on lip 96 of frame member 82. Like cover member 58, cover member 84 is constructed from a flexible material, such as plastic, and dimensioned such that the cover member 84 must be flexed in order for the attachment tabs 92*a*, 92*b* to slip over the receiving tabs 94*a*, 94*b*. As such, the attachment tabs 92*a*, 92*b* resiliently engage the receiving tabs 94*a*, 94*b*.

Figure 6A:
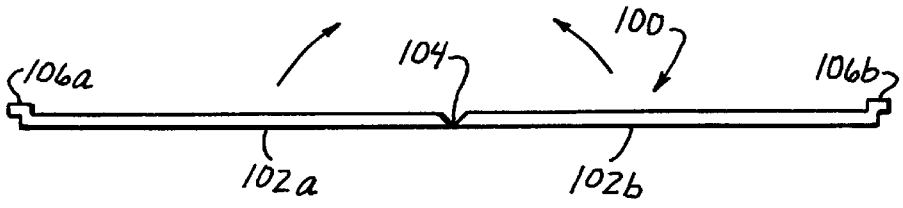
FIG. 6A is an end view of a cover member having a living hinge.
Figure 6B:
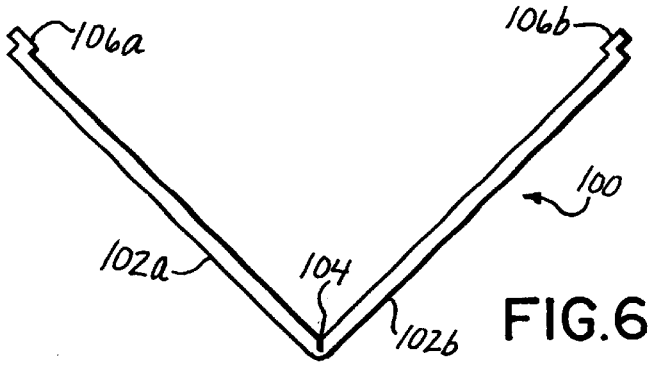
FIG. 6B is an end view of the corner member of FIG. 6A folded along its living hinge.

As is shown in FIG. 5, the cover member 84 is one piece formed from adjoining first and second walls 98*a*, 98*b* which substantially form a right angle between them. An alternate cover member 100 is shown in FIGS. 6A and 6B. The cover member 100 is also constructed of one piece but with first and second walls 102*a*, 102*b* connected by a living hinge 104. The living hinge 104 is made of the same material as first and second walls 102*a*, 102*b*, but with reduced thickness so that the first and second walls 102*a*, 102*b* can be pivoted along the living hinge toward each other to form substantially a right angle between them. As such, attachment tabs 106*a*, 106*b* disposed at opposite edges of first and second walls 102*a*, 102*b* can engage receiving tabs 94*a*, 94*b* on frame member 82.

Figure 7A:
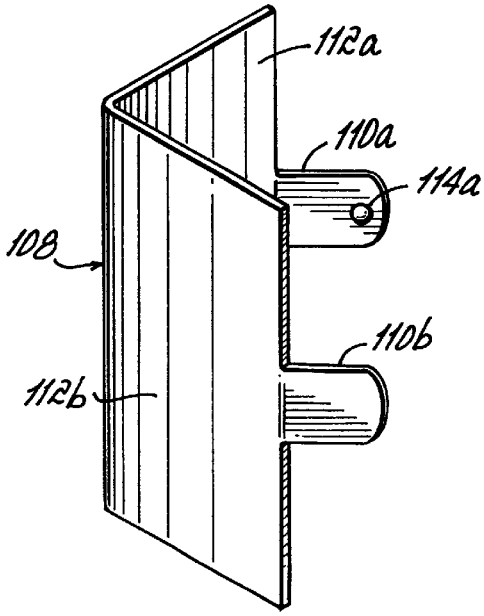
FIG. 7A is a perspective view of the cover member with tabs of FIG. 7.
Figure 7:
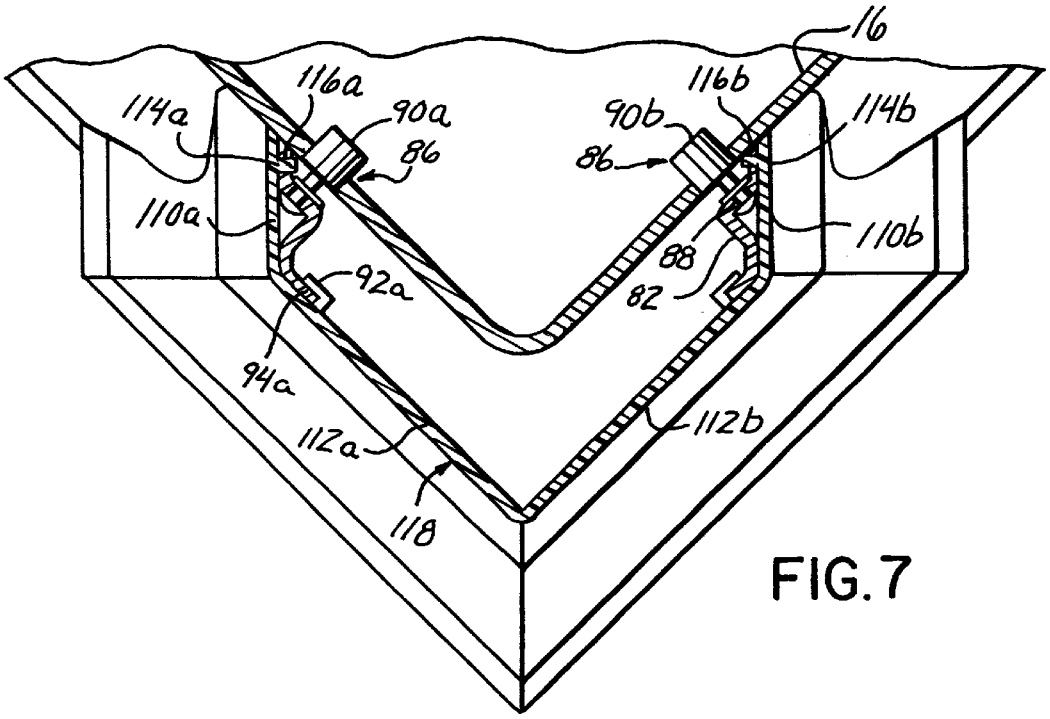
FIG. 7 is a cross-sectional view of another embodiment of the decorative corner hardware with a cover member with tabs to cover mounting hardware.

Another cover member 108 according to the principles of the invention is shown in FIGS. 7 and 7A. The cover member 108 is similar in construction to cover member 84 with the exception of having first and second protruding tabs 110*a*, 110*b* attached respectively to first and second walls 112*a*, 112*b*. First and second protruding tabs 110*a*, 110*b* are adapted to conceal the mounting hardware 86 which is cooperating with mounting throughholes 88 to affix the frame member 82 to the casket shell 16. First and second protruding tabs 110*a*, 110*b* further include first and second retention tabs 114*a*, 114*b* which engage slots 116*a*, 116*b* in the frame member 82. The retention tabs 114*a*, 114*b* help retain the protruding tabs 110*a*, 110*b* as they conceal the mounting hardware 86.

Figure 8:
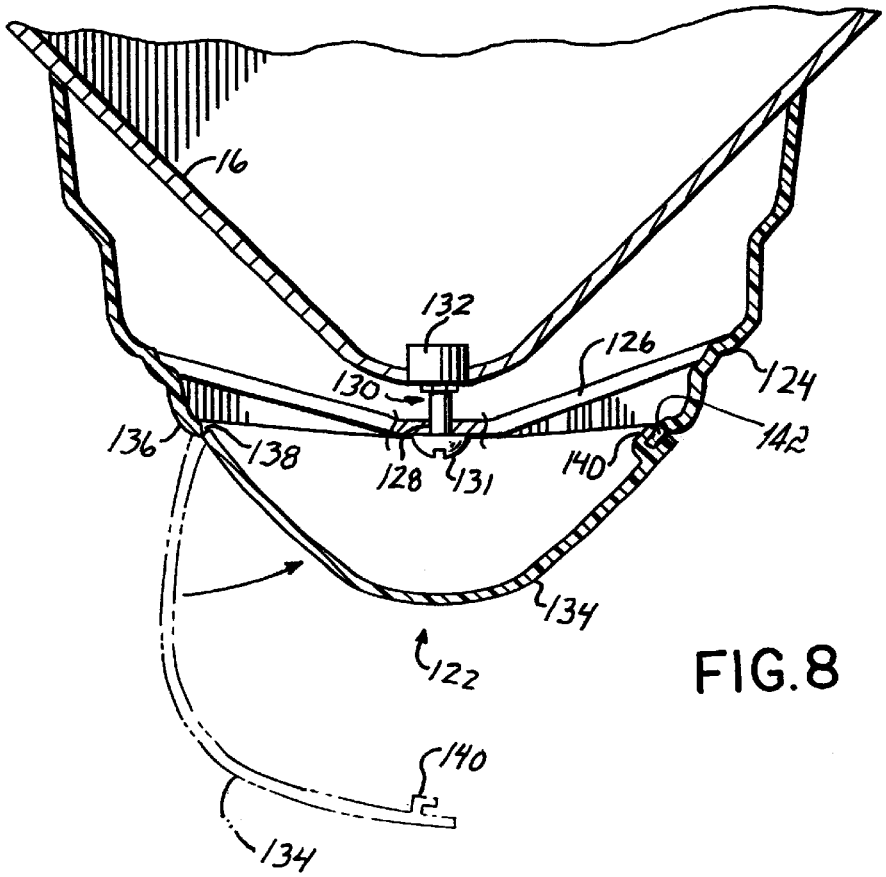
FIG. 8 is a cross-sectional view of an integrally formed decorative corner hardware having an integral living hinge.
Figure 10:
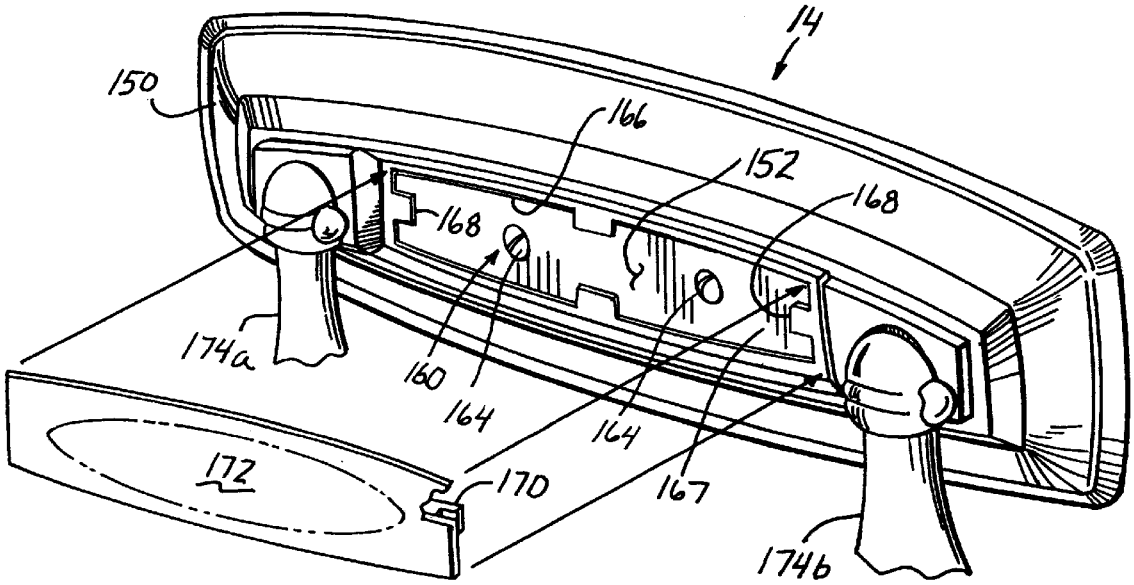

Another embodiment of a corner decorative element 122 is shown in FIG. 8. Unlike the previous embodiments described above, this corner decorative element 122 is essentially a single integrally formed trim piece. The corner decorative element 122 includes a frame portion 124 with an opening (not shown) which is very similar to the opening 30 of frame member 26. A bridge member 126, spanning across the opening in frame portion 124, has a throughhole 128 which receives mounting hardware 130, such as a quarter-turn screw. The mounting hardware 130 cooperates with receiving member 132 to fixedly secure the integrally formed corner decorative element 122 to the casket shell 16. A cover member 134 is pivotally attached a first edge 136 of the opening by a living hinge 138. The cover member 134 has an attachment tab 140 disposed opposite the living hinge 138 that engages a second edge 142 of the opening. When the cover member 134 pivots about the living hinge 138 and attachment tab 140 engages the second edge 142, the opening is covered and the bridge member 126 and the mounting hardware 130 are concealed.

Figure 9:
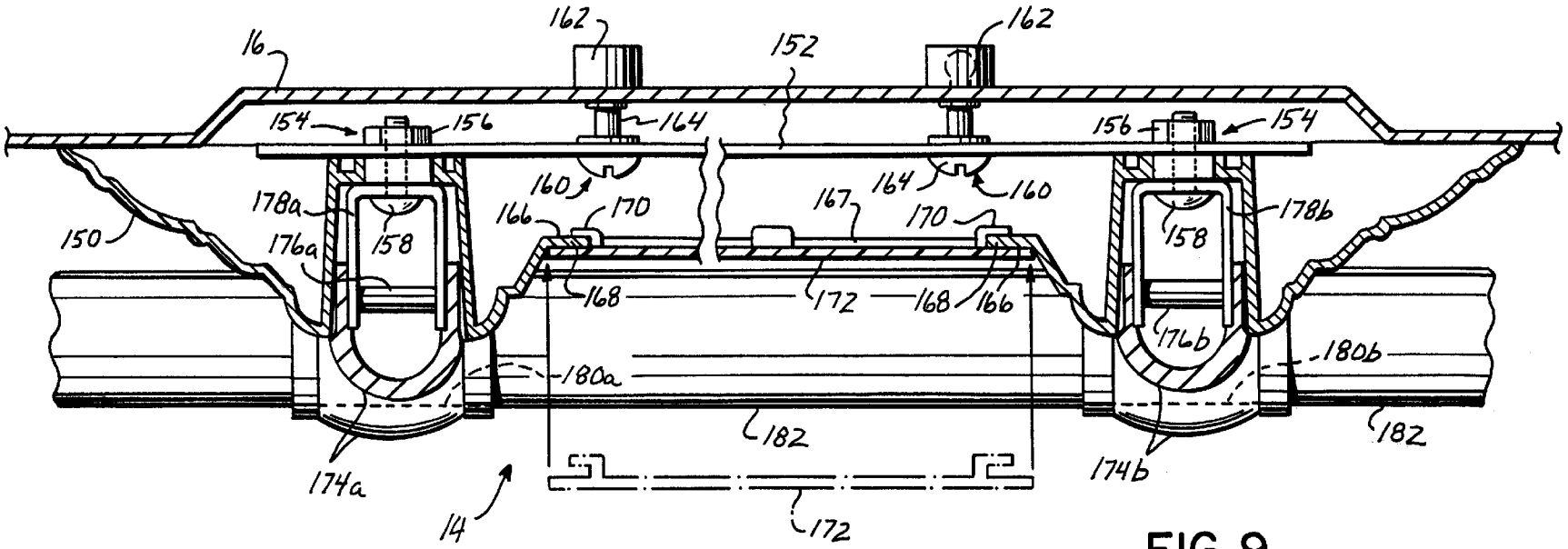
FIG. 9 is an enlarged cross-sectional view of the decorative side hardware of FIG. 1 taken along line 9—9.

One embodiment of the side decorative element 14 is shown in FIG. 9. The side decorative element 14 has a frame member 150 affixed to a mounting plate 152 by mounting hardware 154, preferably a nut 156 and a bolt 158. The mounting plate 152 is in turn detachably affixed to the side of the casket shell 16 by mounting hardware 160 cooperating with receiving members 162. Preferably the mounting hardware 160 is a quarter-turn screw 164, allowing quick installation of the side decorative element 14 to the casket shell 16 with minimal effort. The frame member 150 has a lip 166 which defines an opening (not shown) in the frame member 150. The lip 166 has receiving tabs 168 which engage oppositely disposed attachment tabs 170 on a cover member 172. As such, the cover member 172 is detachably affixed to the frame member 150 so as to cover the opening in the frame member 150 and conceal the mounting hardware 160. The cover member 150 is preferably substantially planar and of flexible construction so that it can be partially distorted in order to slip the attachment tabs 170 over the receiving tabs 168.

As is shown in FIGS. 1 and 9, the side decorative element 14 includes first and second handle supports 174*a*, 174*b* which are pivotally connected by pins 176*a*, 176*b* to support brackets or devises 178*a*, 178*b*. The support brackets 178*a*, 178*b* are affixed to the frame member 150 and the mounting plate 152 by mounting hardware 154. First and second handle supports include first and second handle receiving openings 180*a*, 180*b* through which a handle 182 is disposed therein. Preferably, the handle 182 in cooperation with mounting plate 152 is capable of lifting a portion of the weight of the occupied casket 10.

While the present invention has been illustrated by a description of a preferred embodiment and while this embodiment has been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art.

The invention itself should only be defined by the appended claims, wherein it is claimed:

1. A trim piece for attachment to a casket, comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein at least one of said attachment tabs has an extended portion having a detent mechanism for positively engaging a recess in said lip to further secure said cover member to said frame member.

2. The trim piece of of claim 1 wherein said trim piece is a corner trim piece and said frame member is adapted to be fixedly secured to a corner of the casket.

3. The trim piece of claim 2 wherein said frame member has at least two mounting holes adapted to receive mounting hardware to fixedly secure said frame member to the corner of the casket.

4. The trim piece of any of claim 1 wherein said trim piece is a side trim piece and said frame member is adapted to be fixedly secured to a side of the casket.

5. The trim piece of claim 4 wherein said cover member is substantially planar.

6. The trim piece of claim 5 wherein said lip has oppositely disposed receiving tabs for positively engaging said attachment tabs on said cover member to detachably affix said cover member to said frame member.

7. The trim piece of claim 6 wherein said cover member is flexible and is affixed to said frame member in a flexed condition such that said attachment tabs resiliently engage said receiving tabs.

8. The trim piece of claim 1 wherein said lip has oppositely disposed receiving tabs for positively engaging said attachment tabs on said cover member to detachably affix said cover member to said frame member.

9. The trim piece of claim 8 wherein said cover member is flexible and is affixed to said frame member in a flexed condition such that said attachment tabs resiliently engage said receiving tabs.

10. The trim piece of claim 1 wherein said lip further includes a throughhole covered on one side of said lip by said extended portion, said throughhole adapted to allow a tool to be inserted into said throughhole to engage and bias said extended portion such that said detent mechanism is disengaged from said recess to allow said cover member to be removed from said frame member.

11. A trim piece for attachment to a casket, comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said cover member has adjoining first and second walls forming a right angle therebetween, each of said walls having at least one of said attachment tabs.

12. A trim piece for attachment to a casket, comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a corner trim piece and said frame member is adapted to be fixedly secured to a corner of the casket;

wherein said frame member further includes a bridge member affixed to opposite sides of and thereby spans across said opening, said attachment bridge having a throughhole for receiving mounting hardware to detachably secure said frame member to the corner of the casket.

13. The trim piece of claim 12 wherein said mounting hardware is a screw.

14. The trim piece of claim 13 wherein said screw is a quarter-turn screw.

15. A trim piece for attachment to a casket, comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a corner trim piece and said frame member is adapted to be fixedly secured to a corner of the casket;

wherein said frame member has at least two mounting holes adapted to receive mounting hardware to fixedly secure said frame member to the corner of the casket;

wherein said cover member has adjoining first and second walls forming a right angle therebetween, each of said walls having at least one of said attachment tabs.

16. The trim piece of claim 15 wherein said cover member further includes first and second protruding tabs on said respective first and second walls, said protruding tabs adapted to conceal mounting hardware cooperating with said mounting holes to affix said frame member to the corner of the casket.

17. The trim piece of claim 15 wherein said cover member further includes a living hinge connecting said first and second walls.

18. A trim piece for attachment to a casket, comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a side trim piece and said frame member is adapted to be fixedly secured to a side of the casket; and wherein said cover member is substantially planar;

further comprising:

a mounting plate, said frame member being fixedly attached to said mounting plate, said mounting plate being adapted to be secured to the casket side.

19. The trim piece of claim 18 further comprising:

first and second handle supports attached to said mounting plate, each handle support having first and second handle receiving openings; and a handle disposed in said first and second handle receiving openings.

20. An integrally formed trim piece for attachment to a corner of a casket, comprising:

a frame portion having an opening therethrough;

a bridge member spanning said opening, said bridge member having a throughhole adapted to receive mounting hardware to fixedly secure the integrally formed trim piece to the corner of the casket; and a cover member pivotally attached along a first edge of said opening by a living hinge, said cover member having an attachment tab disposed opposite said living hinge for engaging a second edge of said opening when said cover member is pivoted to cover said opening.

21. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said lip has oppositely disposed receiving tabs for positively engaging said attachment tabs on said cover member to detachably affix said cover member to said frame member.

22. The casket of claim 21 wherein said cover member is flexible and is affixed to said frame member in a flexed condition such that said attachment tabs resiliently engage said receiving tabs.

23. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein at least one of said attachment tabs has an extended portion having a detent mechanism for positively engaging a recess in said lip to further secure said cover member to said frame member.

24. The casket of claim 23 wherein said lip further includes a throughhole covered on one side of said lip by said extended portion, said throughhole adapted to allow a tool to be inserted into said throughhole to engage and push said extended portion such that said detent mechanism is disengaged from said recess to allow said cover member to be removed from said frame member.

25. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said cover member has adjoining first and second walls forming a right angle therebetween, each of said walls having at least one of said attachment tabs.

26. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member and a cover member having at least two attachment tabs oppositely disposed on said cover member and engaging said lip so that said cover member is detachably affixed to and covers said opening in said frame member;

wherein said trim piece is a corner trim niece and said frame member is adapted to be fixedly secured to a corner of the casket;

wherein said frame member further includes a bridge member affixed to opposite sides of and thereby spans across said opening, said attachment bridge having a throughhole for receiving mounting hardware to detachably secure said frame member to the corner of the casket.

27. The casket of claim 26 wherein said mounting hardware is a screw.

28. The casket of claim 27 wherein said screw is a quarter-turn screw.

29. A casket comprising:

a casket shell;

a casket can enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a corner trim piece and said frame member is adapted to be fixedly secured to a corner of the casket;

wherein said frame member has at least two mounting holes adapted to receive mounting hardware to fixedly secure said frame member to the corner of the casket;

wherein said cover member has adjoining first and second walls forming a right angle therebetween, each of said walls having at least one of said attachment tabs.

30. The casket of claim 29 wherein said cover member further includes first and second protruding tabs on said respective first and second walls, said protruding tabs adapted to conceal mounting hardware cooperating with said mounting holes to affix said frame member to the corner of the casket.

31. The casket of claim 29 wherein said cover member further includes a living hinge connecting said first and second walls.

32. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a side trim piece and said frame member is adapted to be fixedly secured to a side of the casket;

wherein said cover member is substantially planar;

further comprising:

a mounting plate, said frame member being fixedly attached to said mounting plate, said mounting plate being secured to the casket side.

33. The casket of claim 32 further comprising:

first and second handle supports attached to said mounting plate, each handle support having first and second handle receiving openings; and a handle disposed in said first and second handle receiving openings.

34. A casket comprising:

a casket shell;

a casket cap enclosing said shell; and a trim piece attached to said casket, said trim piece comprising:

a frame member adapted to be fixedly secured to a portion of the casket, said frame member having a lip defining an opening in said frame member; and a cover member having at least two attachment tabs oppositely disposed on said cover member and engaging said lip so that said cover member is detachably affixed to and covers said opening in said frame member;

wherein said trim piece is a side trim piece and said frame member is adapted to be fixedly secured to a side of the casket;

wherein said cover member is substantially planar;

wherein said lip has oppositely disposed receiving tabs for positively engaging said attachment tabs on said cover member to detachably affix said cover member to said frame member.

35. The casket of claim 34 wherein said cover member is flexible and is affixed to said frame member in a flexed condition such that said attachment tabs resiliently engage said receiving tabs.

36. A casket comprising:

a casket shell;

a casket cap enclosing said shell; and an integrally formed trim piece attached to said casket, said trim piece comprising:

a frame portion having an opening therethrough;

a bridge member spanning said opening, said bridge member having a throughhole adapted to receive mounting hardware to fixedly secure the integrally formed trim piece to the corner of the casket; and a cover member pivotally attached along a first edge of said opening by a living hinge, said cover member having an attachment tab disposed opposite said living hinge for engaging a second edge of said opening when said cover member is pivoted to cover said opening.

* * * * *